US006076449A

United States Patent [19]

Kawaguchi et al.

[11] Patent Number: 6,076,449

[45] Date of Patent: Jun. 20, 2000

[54] VARIABLE DISPLACEMENT COMPRESSOR

[75] Inventors: Masahiro Kawaguchi; Masakazu Murase; Tetsuhiko Fukanuma; Hiroshi Kubo, all of Kariya, Japan

[73] Assignee: Kabushiki Kaisha Toyoda Jidoshokki Seisakusho, Aichi-Ken, Japan

[21] Appl. No.: 09/049,515

[22] Filed: Mar. 27, 1998

[30] Foreign Application Priority Data

Mar. 31, 1997 [JP] Japan ..... 9-080502

[51] Int. Cl.[7] ..... F01B 13/04

[52] U.S. Cl. ..... 92/12.2; 92/57; 92/71; 417/269

[58] Field of Search ..... 92/12.2, 57, 71; 417/269

[56] References Cited

U.S. PATENT DOCUMENTS 5,275,087 1/1994 Akuzawa et al. ..... 417/269 X
5,415,077 5/1995 Ono ..... 417/269 X
5,562,425 10/1996 Kimura et al. ..... 417/269
5,645,405 7/1997 Ota et al. ..... 417/269

FOREIGN PATENT DOCUMENTS 196 22 869 A1 12/1996 Germany .
7-091366A 4/1995 Japan .

*Primary Examiner*—Hoang Nguyen
*Attorney, Agent, or Firm*—Morgan & Finnegan, L.L.P.

[57] ABSTRACT

A variable displacement compressor includes a swash plate supported tiltably on a drive shaft and slidable in axial directions of the drive shaft. The swash plate has a central support hole into which the drive shaft is inserted. The swash plate has a top dead center point for positioning the piston at a top dead center position and a bottom dead center point for positioning the piston at a bottom dead center position. The center of gravity of the swash plate is displaced from the axis of the drive shaft toward the top dead center point. This location of the center of gravity maintains the radial position of the swash plate relative to the drive shaft by centrifugal force acting on the swash plate when the swash plate rotates. As a result, the compressor is quieter and more stable.

19 Claims, 5 Drawing Sheets

VARIABLE DISPLACEMENT COMPRESSOR

BACKGROUND OF THE INVENTION

The present invention relates to variable displacement compressors that are used in vehicle air conditioners and that change the inclination of a drive plate for controlling the displacement.

FIGS. 5 and 6 illustrate a part of such a compressor. This compressor includes housing 105, a drive shaft 102, a rotor 101 fixed to the shaft 102 and a swash plate 103, which functions as a drive plate. A shaft hole 103*a* is formed in the center of the swash plate 103. The drive shaft 102 extends through the hole 103*a*. A predetermined clearance exits between the shaft 102 and the hole 103*a*. The housing 105 has cylinder bores 105*a*. A piston 104 is housed in each cylinder bore 105*a* and is coupled to the periphery of the swash plate 103 by a pair of shoes 106.

A hinge mechanism 107 is located between the rotor 101 and the swash plate 103. The hinge mechanism 107 includes a pair of guide pins 108, which are formed on the swash plate 103, and a support arm 109, which is formed on the rotor 101. Each guide pin 108 has a ball 108*a* at its distal end. A pair of guide holes 109*a* are formed in the support arm 109. The axis of each guide hole 109*a* is inclined relative to a plane perpendicular to the axis L of the drive shaft 102. The ball 108*a* of each guide pin 108 is inserted in the corresponding guide hole 109*a* of the support arm 109. The inner wall 109*b* of each guide hole 109*a* functions as a guide surface that guides the movement of the associated ball 108*a*.

The rotor 101 and the hinge mechanism 107 cause the swash plate 103 to integrally rotate with the drive shaft 102. The rotation of the swash plate 103 is converted into linear reciprocation of the pistons 104 by the shoes 106. The pistons 104 compress refrigerant gas drawn into the cylinder bores 105*a* and discharge the compressed gas from the cylinder bores 105*a*. The swash plate 103 includes a top dead center point D1 that positions each piston 104 at the top dead center in the associated cylinder bore 105*a*. The swash plate 103 also includes a bottom dead center point D2 that positions each piston 104 at the bottom dead center in the associated cylinder bore 105*a*. As shown in FIGS. 5 and 6, a piston 104 that corresponds to the top dead center point D1 is located at the top dead center. When the swash plate 103 is rotated by 180 degrees from the states of FIGS. 5 and 6, the illustrated piston 104 will correspond to the bottom dead center point D2 and be located at the bottom dead center.

The hinge mechanism 107 guides the swash plate 103 to tilt between the maximum inclination shown in FIG. 5 and the minimum inclination shown in FIG. 6. Tilting of the swash plate 103 causes the guide balls 108*a* of the guide pins 108 to slide in the guide holes 109*a*. Also, the tilting causes the swash plate 103 to slide on the drive shaft 102. The clearance between the hole 103*a* of the swash plate 103 and the drive shaft 102 allows the swash plate 103 to smoothly move on the drive shaft 102. When the inclination of the swash plate 103 is changed, the bottom dead center of each piston 104 is changed while its top dead center remains unchanged. Accordingly, the stroke of the pistons 104 is changed. The changes in the piston stroke vary the displacement of the compressor.

When each piston 104 is located at the top dead center, the top clearance of each piston 104 (the distance between the end of the piston 104 and a valve plate, which is not illustrated in the drawings) is preferably as close to zero as possible and constant. Such a top clearance allows the compressor to constantly operate with a high compression efficiency at any given inclination angle of the swash plate 103. The hinge mechanism 107 is therefore designed to maintain a predetermined top dead center position for each piston 104 at any given inclination angle of the swash plate 103.

When at the maximum inclination position as shown in FIG. 5, the swash plate 103 maximizes the stroke of the pistons 104 thereby maximizing the compression ratio of refrigerant gas. At this time, the gas compressing process generates relatively large reactive forces. The reactive forces result in a relatively large force F. The force F acts on the inner wall 109*b* of the guide hole 109*a* through the pistons 104, the swash plate 103 and the balls 108*a* of the guide pins 108. The inner wall 109*b* is inclined relative to a plane perpendicular to the axis L of the drive shaft 102. Therefore, the force F is divided into a component F1 that is parallel to the inner wall 109*b* and a component F2 that is normal to the inner wall 109*b*.

The component F1 is directed away from the axis L of the drive shaft 102 and therefore moves the swash plate 103 upward as viewed in FIG. 5. In other words, the component F1 moves the top dead center point D1 of the swash plate 103 away from the axis L of the drive shaft 102. As a result, as shown in FIG. 5, a specific point (a point radially corresponding to the bottom dead center point D2) of the hole 103*a* is pressed against the drive shaft 102. In other words, the swash plate 103 is rotated integrally with the drive shaft 102 with the point corresponding to the point D2 pressed against the shaft 102. In this state, the swash plate 103 does not radially chatter relative to the drive shaft 102.

When at the minimum inclination position as shown in FIG. 6, the swash plate 103 minimizes the stroke of the pistons 104 thereby minimizing the compression ratio of refrigerant gas. This diminishes the force F generated by compression reaction forces acting on the pistons 104. The component F1 is decreased, accordingly. The force that moves the top dead center point D1 away from the axis L of the drive shaft 102 is thus weaker. When this force is smaller than the force of gravity acting on the swash plate 103, the swash plate 103 is moved by gravity.

For example, in FIG. 6, the swash plate 103 is moved in the direction of gravity (downward as viewed in FIG. 6). That is, a point on the inner wall of the hole 103*a* radially corresponding to the top dead center point D1 contacts the drive shaft 102. When the swash plate 103 is rotated by 180 degrees from the state of FIG. 6, a point on the inner wall of the hole 103*a* corresponding to the bottom dead center point D2 contacts the drive shaft 102. In other words, rotation of the swash plate 103 keeps changing the point on the inner wall of the hole 103*a* that contacts the drive shaft 102, thereby radially chattering the swash plate 103 with respect to the drive shaft 102. This results in noise and vibration.

When the swash plate 103 is at the maximum inclination position as shown in FIG. 5, a point on the inner wall of the hole 103*a* corresponding to the bottom dead center point D2 constantly contacts the drive shaft 102. On the other hand, when the swash plate 103 is at the minimum inclination position as shown in FIG. 6, a point on the inner wall of the hole 103*a* corresponding to the top dead center point D1 contacts the drive shaft 102. That is, the radial position of the swash plate 103 with respect to the axis L of the drive shaft 102 is different in the state of FIG. 5 from the state of FIG. 6. This causes the top dead center position of the piston 104 illustrated in FIG. 6 to be closer to the valve plate (not shown) than the top dead center position of the piston 104 illustrated in FIG. 5. In other words, the top dead center of FIG. 6 is moved toward the top of the cylinder bore 105*a* (to the right as viewed in the drawings) from the top dead center of FIG. 5. In other words, the top clearance of the piston 104 when at the top dead center is unstable. This causes unstable compression of refrigerant gas. Further, the pistons 104 must be prevented from contacting the valve plate. The top clearance of the pistons 104 therefore cannot be set too close to zero.

SUMMARY OF THE INVENTION

Accordingly, it is an objective of the present invention to provide a variable displacement compressor that maintains the radial position of a swash plate with respect to a drive shaft at a predetermined position.

To achieve the above objective, the variable displacement compressor according to the present invention includes a housing having a cylinder bore, a piston located in the cylinder bore, a drive shaft rotatably supported by the housing, a rotary support mounted on the drive shaft to rotate integrally with the drive shaft, a drive plate operably connected to the piston to convert rotation of the drive shaft to reciprocation of the piston, and a hinge mechanism located between the rotary support and the drive plate. The drive plate has a central support hole into which the drive shaft is inserted. The support hole allows the drive plate to be supported tiltably on the drive shaft and to slide in axial directions of the drive shaft. The drive plate slides and tilts on the drive shaft between a maximum inclination position and a minimum inclination position. The piston moves by a stroke based on the inclination of the drive plate to change the displacement of the compressor. The hinge mechanism rotates the drive plate integrally with the rotary support and guides the tilting motion and the sliding motion of the drive plate. The mass of the drive plate is arranged and located such that the radial position of the drive plate with respect to the drive shaft is maintained constant by centrifugal force when the drive plate rotates, regardless of the inclination of the drive plate.

Also, the present invention provides a swash plate used for a variable displacement compressor. The swash plate has a top dead center point for positioning the piston at a top dead center position in the cylinder bore and a bottom dead center point for positioning the piston at a bottom dead center position in the cylinder bore. The center of gravity of the swash plate is displaced from the axis of the drive shaft toward the top dead center point.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A variable displacement compressor according to one embodiment of the present invention will be described. This compressor is used in a vehicle air conditioner system.

Figure 1:
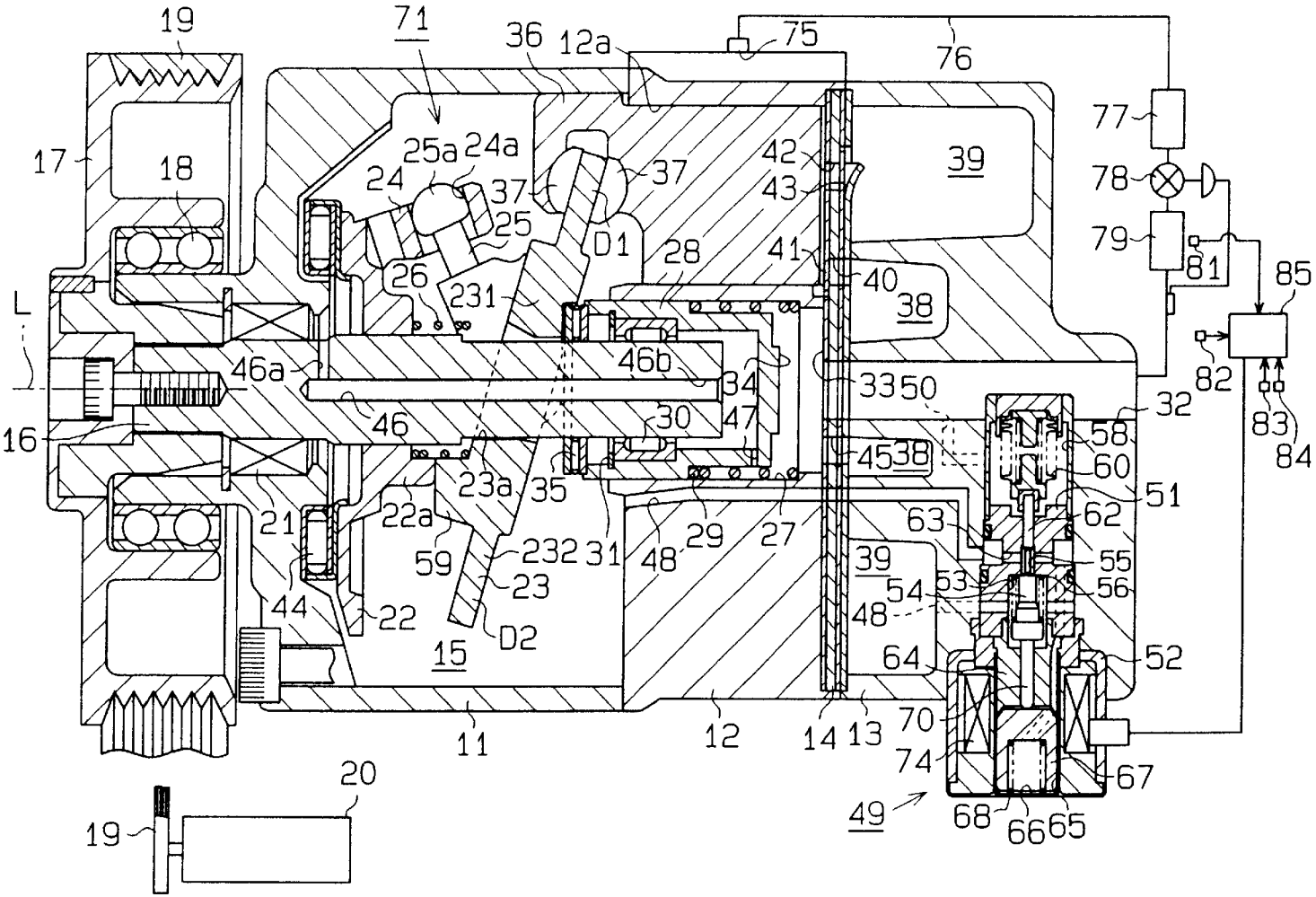
FIG. 1 is a cross-sectional view illustrating a variable displacement compressor according to one embodiment of the present invention.

As shown in FIG. 1, a front housing 11 is secured to the front end face of a cylinder block 12. A rear housing 13 is secured to the rear end face of the cylinder block 12 with a valve plate 14. A crank chamber 15 is defined by the inner walls of the front housing 11 and the front end face of the cylinder block 12. A drive shaft 16 is rotatably supported in the front housing 11 and the cylinder block 12 and extends through the crank chamber 15.

The front housing 11 has a cylindrical wall extending forward. The front end of the drive shaft 16 is located in the cylindrical wall of the front housing and is secured to a pulley 17. The pulley 17 is rotatably supported by the cylindrical wall with an angular bearing 18. The pulley 17 is directly coupled to an external drive source (a vehicle engine 20 in this embodiment) by a belt 19. The compressor of this embodiment is referred to as a clutchless type variable displacement compressor since it is not clutched on and off.

A lip seal 21 is located between the drive shaft 16 and the front housing 11 for sealing the crank chamber 15. That is, the lip seal 21 prevents refrigerant gas in the crank chamber 15 from leaking outside.

A rotor 22 is fixed to the drive shaft 16 in the crank chamber 15. The crank chamber 15 also accommodates a swash plate 23, which functions as a drive plate. A hole 23*a* is formed in the center of the swash plate 23. The drive shaft 16 extends through the hole 23*a* for supporting the swash plate 23. The swash plate 23 slides along and tilts with respect to the axis L of the shaft 16. A predetermined clearance exits between the hole 23*a* and the drive shaft 16 for allowing the swash plate 23 to move smoothly with respect to the drive shaft 16. The rotor 22 is coupled to the swash plate 23 by a hinge mechanism 71. The swash plate 23 has a counterweight 59 located at the opposite side of the hinge mechanism 71 with respect to the axis L of the drive shaft 16.

Figure 3:
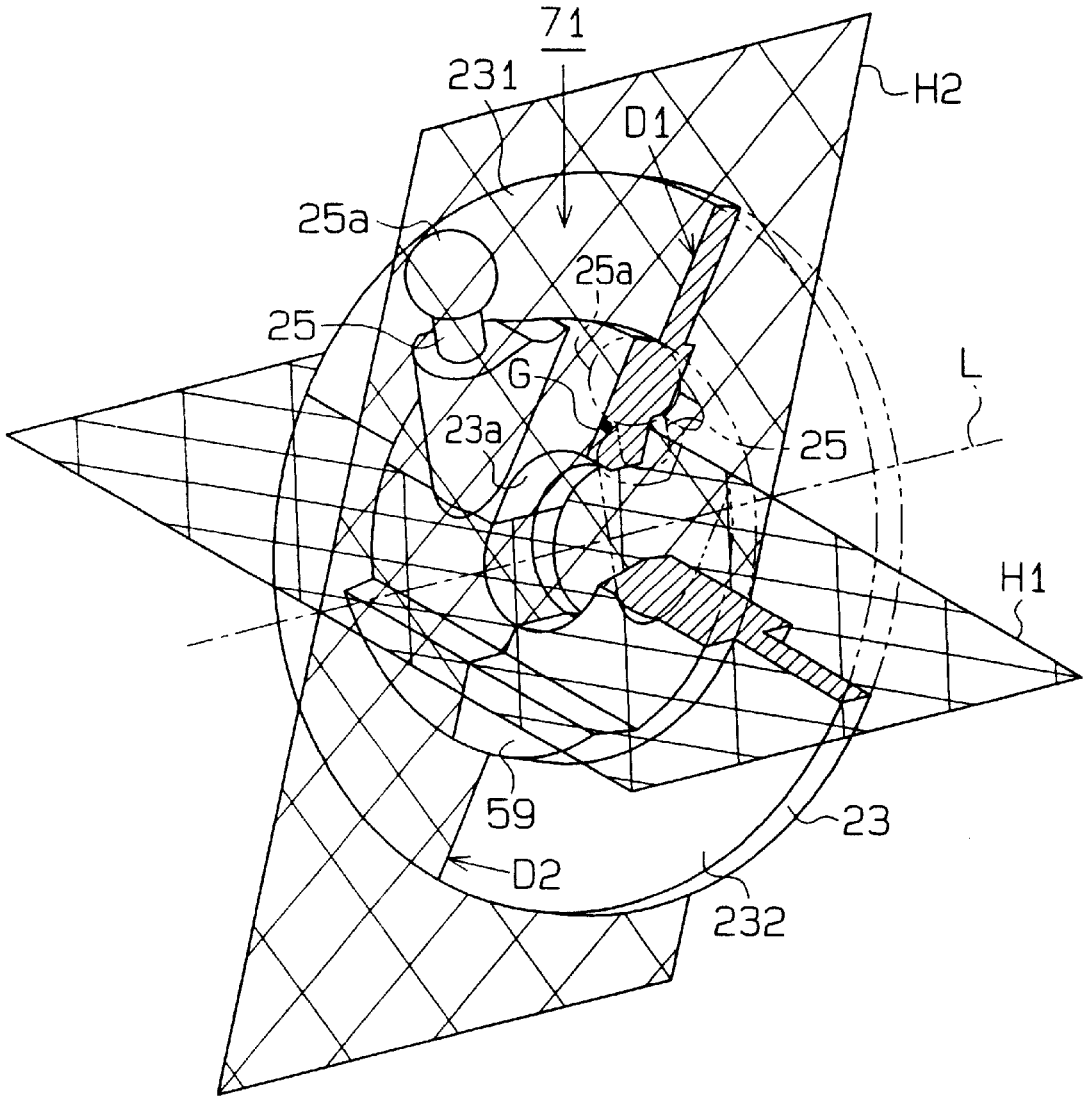
FIG. 3 is a perspective view, with a part cut away, illustrating a swash plate.
Figure 4:
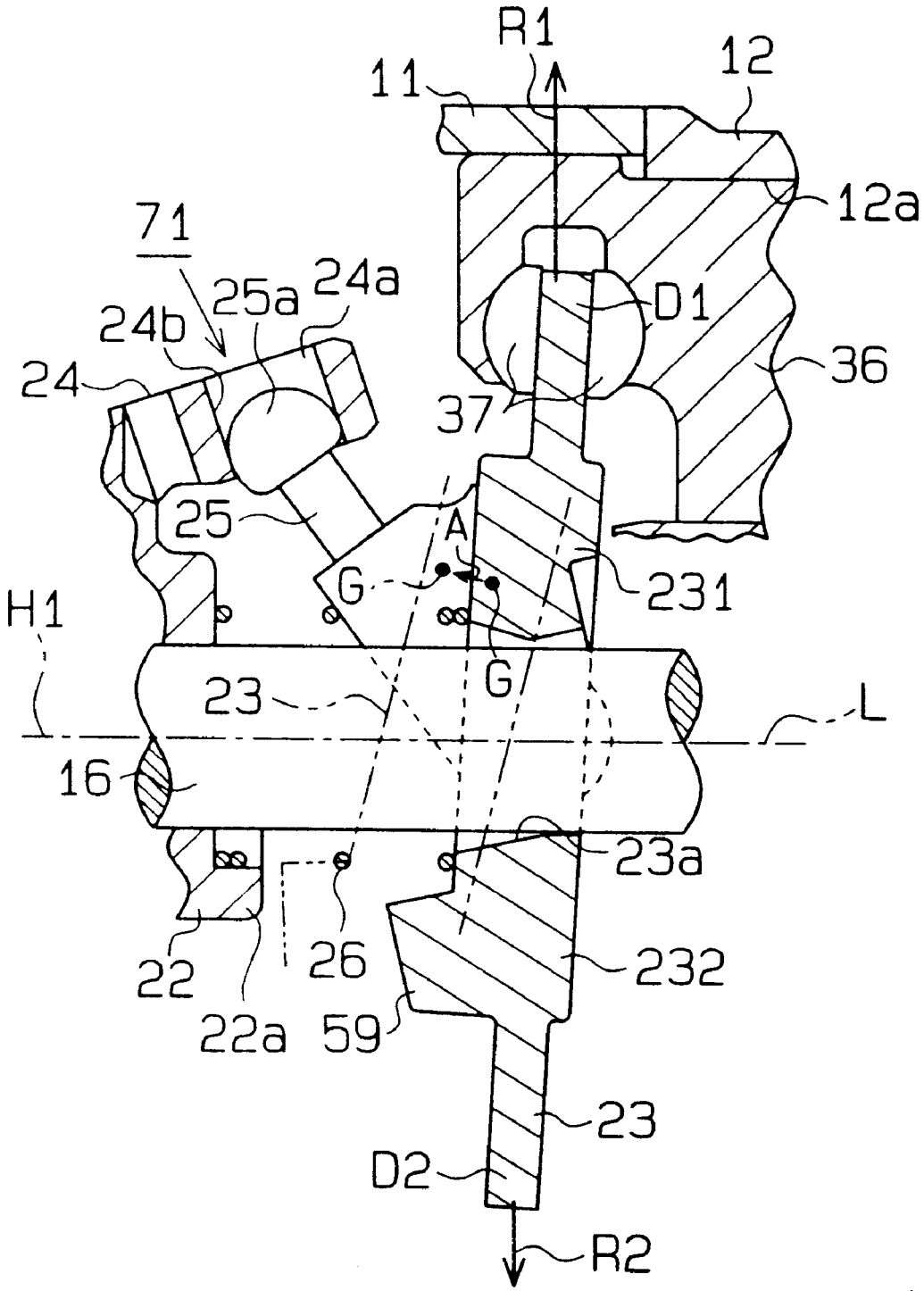
FIG. 4 is an enlarged partial cross-sectional view illustrating the compressor of FIG. 1.
Figure 6:
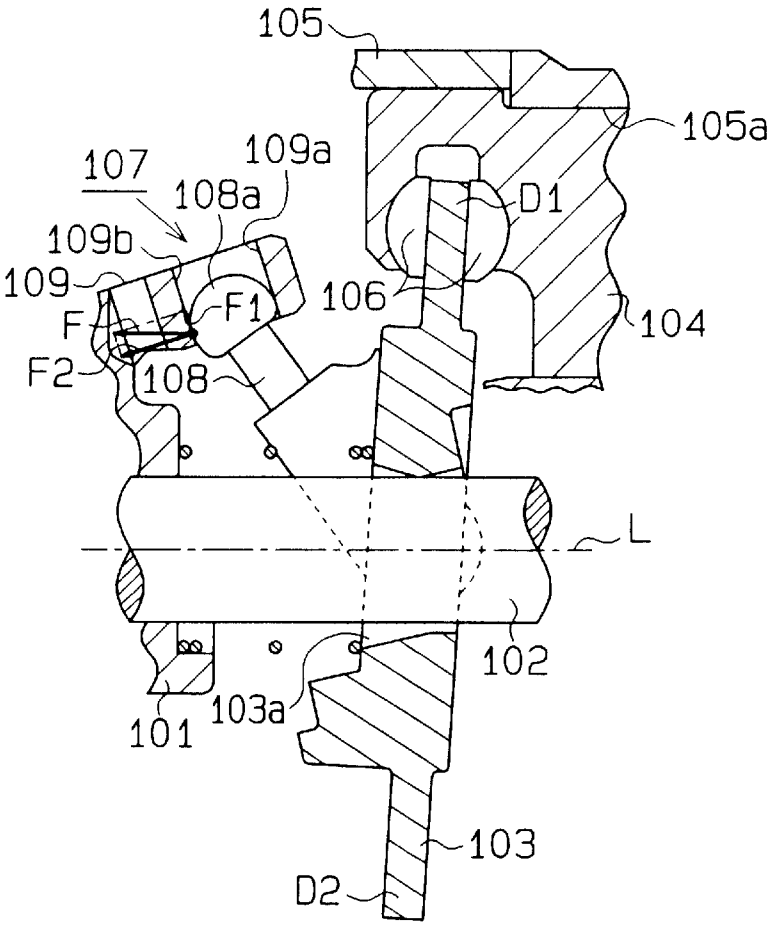
Fig.6 (Prior Art)
FIG. 6 is an enlarged partial cross-sectional view like FIG. 5 when the inclination of the swash plate is minimum.

As shown in FIGS. 3 and 4, a pair of guide pins 25 are formed on the front face of the swash plate 23 and extend forward. The swash plate 23 includes a top dead center point D1 that positions each piston 36 at the top dead center. The swash plate 23 also includes a bottom center point D2 that positions each piston 36 at the bottom dead center. An imaginary plane H2 in FIG. 3 includes the top dead center point D1, the bottom dead center point D2 and the axis L of the drive shaft 16. Another imaginary plane H1 is normal to the plane H2 and includes the axis L of the drive shaft 16. The guide pins 25 are symmetric with respect to the plane H2.

The guide pins 25 project toward the rotor 22 and have guide balls 25*a* at the distal ends. A pair of support arms 24 formed on the rear face of the rotor 22 and extend toward the swash plate 23. The support arms 24 are symmetrical with respect to the imaginary plane H2. Each arm 24 has a guide hole 24*a* in the distal end. The axis of the guide hole 24*a* is inclined with respect to a plane perpendicular to the axis L of the drive shaft 16. The ball 25*a* of each guide pin 25 is slidably inserted in the corresponding guide hole 24*a*. The inner wall 24*b* of each guide hole 24*a* functions as a guide surface that guides the associated ball 25*a*.

The cooperation of the arms 24 and the guide pins 25 permits the swash plate 23 to rotate together with the drive shaft 16. The cooperation also guides the tilting of the swash plate 23 and the movement of the swash plate 23 along the axis L of the drive shaft 16. As the swash plate 23 slides rearward toward the cylinder block 12, the inclination of the swash plate 23 decreases.

Figure 2:
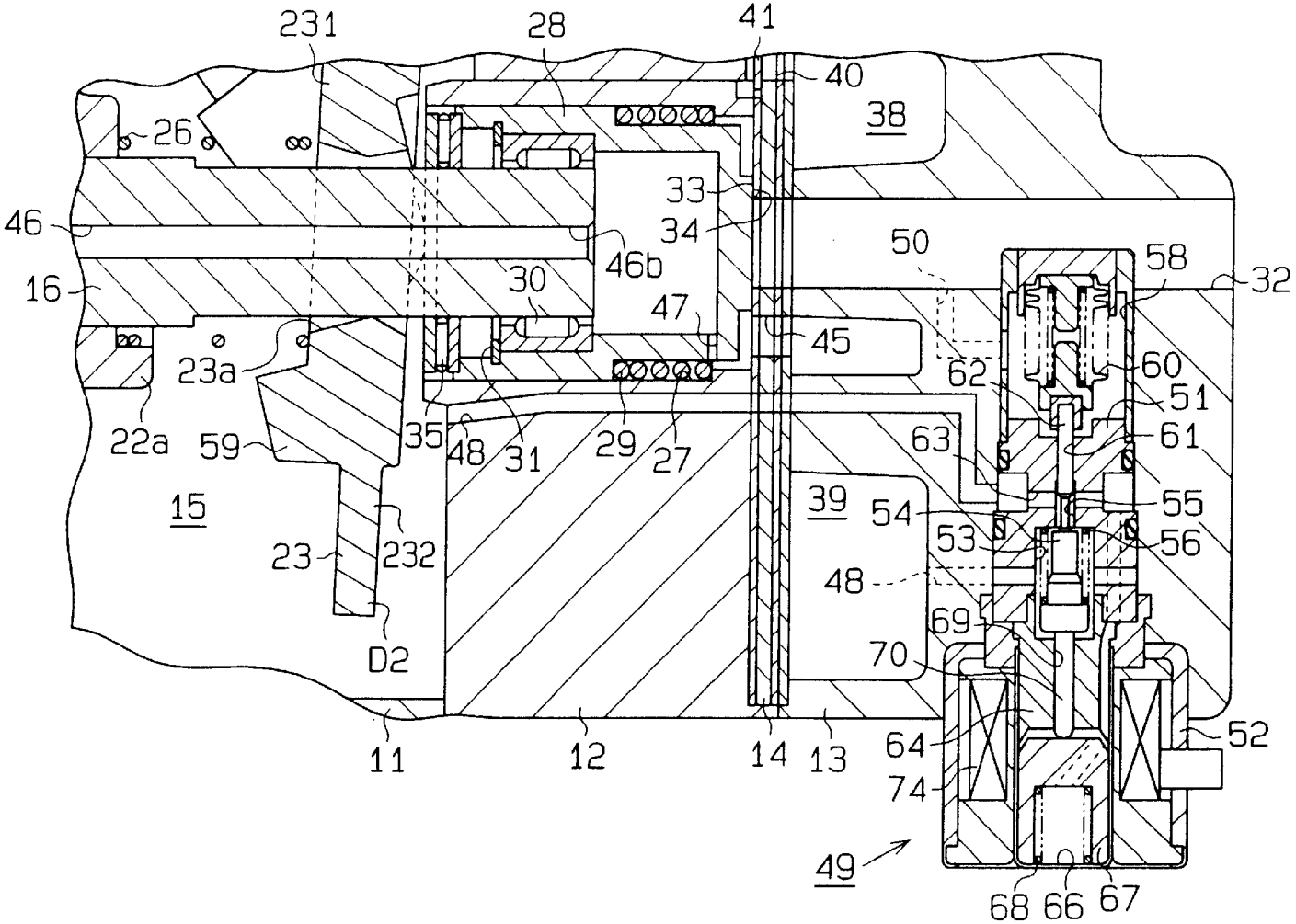
FIG. 2 is an enlarged partial cross-sectional view illustrating the compressor of FIG. 1 when the inclination of the swash-plate is minimum.

As shown in FIGS. 1 and 2, a coil spring 26 is located about the drive shaft 16 between the rotor 22 and the swash plate 23. The spring 26 urges the swash plate 23 rearward, or in a direction to decrease the inclination of the swash plate 23. The rotor 22 has a projection 22*a* on its rear end face. Abutment of the swash plate 23 against the projection 22*a* limits the maximum inclination of the swash plate 23.

The cylinder block 12 has a shutter chamber 27 at its center portion. The shutter chamber 27 extends along the axis L of the drive shaft 16. A hollow cylindrical shutter 28 with a closed end is slidably accommodated in the shutter chamber 27. A coil spring 29 is located between a step formed in the shutter chamber 27 and the shutter 28 for urging the shutter 28 toward the swash plate 23.

The rear end of the drive shaft 16 is inserted in the shutter 28. A radial bearing 30 is located between the rear end of the drive shaft 16 and the inner wall of the shutter 28. The radial bearing 30 is fixed to the shutter 28 by a snap ring 31 and therefore moves integrally with the shutter 28 relative to the drive shaft 16 along the axis L of the drive shaft 16. The rear end of the drive shaft 16 is rotatably supported by the inner wall of the shutter chamber 27 with the radial bearing 30 and the shutter 28 in between.

A suction passage 32 is defined at the center portion of the rear housing 13 and the valve plate 14. The inner end of the passage 32 communicates with the shutter chamber 27. A positioning surface 33 is formed on the valve plate 14 about the inner opening of the suction passage 32. The rear end face of the shutter 28 functions as a shutter surface 34 that abuts against the positioning surface 33. The abutment prevents the shutter 28 from further moving rearward away from the rotor 22 and disconnects the suction passage 32 from the shutter chamber 27.

A thrust bearing 35 is slidably supported on the drive shaft 16 and is located between the swash plate 23 and the shutter 28. The force of the spring 29 constantly retains the thrust bearing 35 between the swash plate 23 and the shutter 28.

As its inclination decreases, the swash plate 23 moves rearward and pushes the shutter 28 rearward with the thrust bearing 35. That is, the swash plate 23 moves the shutter 28 toward the positioning surface 33 against the force of the spring 29. Abutment of the shutter surface 34 of the shutter 28 against the positioning surface 33 as illustrated in FIG. 2 limits the minimum inclination of the swash plate 23. The minimum inclination of the swash plate 23 is slightly more than zero degrees. Zero degrees refers to the angle of the swash plate's inclination when it is perpendicular to the axis L of the rotary shaft 16.

The cylinder block 12 includes cylinder bores 12*a* about the axis L of the drive shaft 16. Each cylinder bore 12*a* houses a single-headed piston 36. Each piston 36 is operably coupled to the swash plate 23 by a pair of shoes 37. Rotation of the swash plate 23 is converted into reciprocation of each piston 36 in the associated cylinder bore 12*a* by the shoes 37. As shown in FIG. 1, a piston 36 corresponding to the top dead center point D1 on the swash plate 23 is located at the top dead center. When the swash plate 23 is rotated by 180 degrees from the state of FIG. 1, the illustrated piston 36 will be axially aligned with the bottom dead center point D2 of the swash plate 23. This positions the piston 36 at the bottom dead center. The top clearance of each piston 36 when at the top dead center is set close to zero.

Changes in the inclination of the swash plate 23 alter the bottom dead center of the pistons 36 while maintaining the top dead center unchanged. As a result, the stroke of the pistons 36 is changed, and the displacement of the compressor is varied, accordingly. The constant top dead center of the pistons 36 represents a constant top clearance of the pistons 36. In other words, the top clearance of the pistons 36 is maintained at a predetermined value, which is close to zero, at any given displacement of the compressor.

The rear housing 13 includes an annular suction chamber 38 and an annular discharge chamber 39. The discharge chamber 39 is defined about the suction chamber 38. The valve plate 14 has suction ports 40 and discharge ports 42. Each suction port 40 and each discharge port 42 correspond to one of the cylinder bores 12*a*. The valve plate 14 has suction valve flaps 41 and discharge valve flaps 43. Each suction valve flap 41 corresponds to one of the suction ports 40 and each discharge valve flap 43 corresponds to one of the discharge ports 42.

As each piston 36 moves from the top dead center to the bottom dead center in the associated cylinder bore 12*a*, refrigerant gas in the suction chamber 38 enters the cylinder bore 12*a* through the associated suction port 40 while causing the associated suction valve flap 41 to flex to an open position. As each piston 36 moves from the bottom dead center to the top dead center in the associated cylinder bore 12*a*, refrigerant gas is compressed in the cylinder bore 12*a* and is discharged to the discharge chamber 39 through the associated discharge port 42 while causing the associated discharge valve flap 43 to flex to an open position.

A thrust bearing 44 is located between the front housing 11 and the rotor 22. The thrust bearing 44 carries the reactive force of gas compression acting on the rotor 22 through the pistons 36 and the swash plate 23.

The suction chamber 38 is connected with the shutter chamber 27 by a hole 45. When contacting the positioning surface 33, the shutter surface 34 of the shutter 28 disconnects the hole 45 from the suction passage 32.

The drive shaft 16 has an axial passage 46. The passage 46 has an inlet 46*a*, which opens to the crank chamber 15 in the vicinity of the lip seal 21, and an outlet 46*b*, which opens to the interior of the shutter 28. The interior of the shutter 28 is connected with the shutter chamber 27 by a pressure release hole 47, which is formed in the shutter wall near the rear end of the shutter 28. The passage 46, the hole 47 and the interior of the shutter chamber 27 function as a bleeding passage that releases refrigerant gas from the crank chamber 15 to the suction chamber 38.

The discharge chamber 39 is connected with the crank chamber 15 by a supply passage 48. The supply passage 48 is regulated by a displacement control valve 49, which is accommodated in the rear housing 13. The control valve 49 is connected with the suction passage 32 by a pressure introduction passage 50.

As shown in FIG. 2, the control valve 49 includes a valve housing 51 and the solenoid 52. The housing 51 and the solenoid 52 are secured to each other and define a valve chamber 53 in between. The valve chamber 53 accommodates a valve body 54. The housing 51 also has a valve hole 55 extending along its axis. The lower opening of the valve hole 55 faces the valve body 54. An opening spring 56 extends between the valve body 54 and a wall of the valve chamber 53. The spring 56 urges the valve body 54 in a direction opening the valve hole 55. The valve chamber 53 is connected with the discharge chamber 39 by the upstream portion of the supply passage 48.

A pressure sensing chamber 58 is defined in the upper portion of the control valve 49 on top of the housing 51. The sensing chamber 58 is connected with the suction passage 32 by the pressure introduction passage 50 and accommodates a bellows 60, which functions as a pressure sensing member. A rod hole 61 is formed in the housing 51 to connects the pressure sensing chamber 58 with the valve chamber 53. A lower part of the rod hole 61 constitutes the valve hole 55. The rod hole 61 slidably accommodates a rod 62. The rod 62 operably couples the valve body 54 with the bellows 60. The rod 62 has a small diameter portion, which extends within the valve hole 55. The clearance between the small diameter portion and the valve hole 55 permits the flow of refrigerant gas.

A port 63 is defined in the housing 51 between the valve chamber 53 and the pressure sensing chamber 58. The port 63 is connected with the crank chamber 15 by the downstream portion of the supply passage 48. That is, the valve chamber 53, the valve hole 55 and the port 63 constitute a part of the supply passage 48.

The solenoid 52 has an plunger chamber 66 having an open upper end. A fixed steel core 64 is press fitted in the upper opening of the plunger chamber 66. A cylindrical plunger 67 with a closed upper end is slidably housed in the plunger chamber 66. A follower spring 68 extends between the plunger 67 and the bottom of the plunger chamber 66. The force of the follower spring 68 is smaller than the force of the opening spring 56. The plunger chamber 66 is connected with the valve chamber 53 by a rod hole 69 formed in the fixed core 64. A solenoid rod 70 is formed integrally with the valve body 54 and slidably housed in the hole 69. The forces of the opening spring 56 and the follower spring 68 cause the distal end of the solenoid rod 70 to constantly contact the plunger 67. Thus, the plunger 67 and the valve body 54 move integrally with the solenoid rod 70 in between. A cylindrical coil 74 is located about the fixed core 64 and the plunger 67.

An outlet 75 is formed in the cylinder block 12 and is connected with the discharge chamber 39. The outlet 75 is connected to the suction passage 32 by an external refrigerant circuit 76. The refrigerant circuit 76 includes a condenser 77, an expansion valve 78 and an evaporator 79. The compressor, the condenser 77, the expansion valve 78 and the evaporator 79 are mounted on a vehicle and function as a vehicle air conditioning system.

A temperature sensor 81 is located in the vicinity of the evaporator 79. The temperature sensor 81 detects the temperature of the evaporator 79 and issues signals relating to the detected temperature to a computer 85. The computer 85 is also connected to a compartment temperature sensor 82, an air conditioner starting switch 83, temperature adjuster 84 and the coil 74 of the control valve 49. A passenger sets a desirable compartment temperature, or a target temperature, by the temperature adjuster 84.

The operation of the above described compressor will now be described.

When the air conditioner starting switch 83 is on, if the temperature detected by the compartment temperature sensor 82 is higher than a target temperature set by the temperature adjuster 84, the computer 85 feeds the coil 74 with a current. The current produces a magnetic attractive force between the fixed core 64 and the plunger 67 in accordance with the current magnitude. The attractive force is transmitted to the valve body 54 by the solenoid rod 70 and urges the valve body 54 against the force of the opening spring 56 in a direction closing the valve hole 55. On the other hand, the length of the bellows 60 varies in accordance with the suction pressure in the suction passage 32 that is introduced to the pressure sensing chamber 58 via the pressure introduction passage 50. The changes in the length of the bellows 60 are transmitted to the valve body 54 by the rod 62.

The opening area between the valve body 54 and the valve hole 55 is determined by the equilibrium of the forces acting on the valve body 54. Specifically, the opening area is determined by the equilibrium position of the body 54, which is affected by the force of the solenoid 52, the force of the bellows 60 and the force of the opening spring 56.

When the cooling load is great, the temperature in the vehicle compartment detected by the sensor 82 is much higher than a target temperature set by the temperature adjuster 84, and the suction pressure is high. The computer 85 increases the magnitude of the current sent to the coil 74 as the difference between the compartment temperature and the target temperature increases. This increases the attractive force between the fixed core 64 and the plunger 67, thereby increasing the resultant force that causes the valve body 54 to close the valve hole 55. Accordingly, the pressure required for moving the valve body 54 in a direction closing the valve hole 55 is lowered. In this state, the valve body 54 changes the opening of the valve hole 55 in accordance with relatively low suction pressure. In other words, as the magnitude of the current to the control valve 49 is increased, the valve 49 functions to maintain the pressure (the target suction pressure) at a lower level.

A smaller opening area between the valve body 54 and the valve hole 55 decreases the amount of refrigerant gas flow from the discharge chamber 39 to the crank chamber 15 via the supply passage 48. The refrigerant gas in the crank chamber 15 flows into the suction chamber 38 via the passage 46 and the pressure release hole 47. This lowers the pressure in the crank chamber 15. Further, when the cooling load is great, the suction pressure is high. Accordingly, the pressure in each cylinder bore 12*a* is high. Therefore, the difference between the pressure in the crank chamber 15 and the pressure in the cylinder bores 12*a* is small. This increases the inclination of the swash plate 23, thereby causing the compressor to operate at a large displacement.

When the valve hole 55 is completely closed by the valve body 54, the supply passage 48 is closed. This stops the supply of highly pressurized refrigerant gas in the discharge chamber 39 to the crank chamber 15. Therefore, the pressure in the crank chamber 15 becomes substantially equal to the low pressure in the suction chamber 38. The inclination of the swash plate 23 thus becomes maximum as shown in FIG. 1, and the compressor operates at the maximum displacement.

When the cooling load is small, the difference between the compartment temperature detected by the sensor 82 and a target temperature set by the temperature adjuster 84 is small, and the suction pressure is low. The computer 85 decreases the magnitude of the current sent to the coil 74 as the difference between the compartment temperature and the target temperature becomes smaller. This decreases the attractive force between the fixed core 64 and the plunger 67, thereby decreasing the resultant force that moves the valve body 54 in a direction closing the valve hole 55. This raises the suction pressure required for moving the valve body 54 in a direction to close the valve hole 55. In this state, the valve body 54 changes the opening of the valve hole 55 in accordance with relatively high suction pressure. In other words, as the magnitude of the current to the control valve 49 is decreased, the valve 49 functions to maintain the suction pressure (target suction pressure) at a higher level.

A larger opening area between the valve body 54 and the valve hole 55 increases the amount of refrigerant gas flow from the discharge chamber 39 to the crank chamber 15. This increases the pressure in the crank chamber 15. Further, when the cooling load is small, the suction pressure is low and the pressure in the cylinder bores 12*a* is low. Therefore, the difference between the pressure in the crank chamber 15 and the pressure in the cylinder bores 12*a* is great. This decreases the inclination of the swash plate 23. The compressor thus operates at a small displacement.

As the cooling load approaches zero, the temperature of the evaporator 79 drops to a frost forming temperature. When the temperature sensor 81 detects a temperature that is equal to or lower than the frost forming temperature, the computer 85 stops sending current to the coil 74. The computer 85 also stops sending current to the coil 74 when the air conditioner starting switch 83 is turned off.

Stopping the current to the coil 74 stops the magnetic attractive force between the fixed core 64 and the plunger 67. The valve body 54 is then moved by the force of the opening spring 56 against the force of the follower spring 68 transmitted by the plunger 67 and the second rod 70 as illustrated in FIG. 2. In other words, the valve body 54 is moved in a direction to open the valve hole 55. This maximizes the opening area between the valve body 54 and the valve hole 55. Accordingly, gas flow from the discharge chamber 39 to the crank chamber 15 is increased. This further raises the pressure in the crank chamber 15, thereby minimizing the inclination of the swash plate 23. The compressor thus operates at the minimum displacement.

As described above, when the magnitude of the current to the coil 74 is increased, the valve body 54 of the control valve 49 functions such that the opening of the valve hole 55 is closed by a lower suction pressure. When the magnitude of the current to the coil 74 is decreased, on the other hand, the valve body 54 functions such that the opening of the valve hole 55 is closed by a higher suction pressure. The compressor changes the inclination of the swash plate 23 to adjust its displacement thereby maintaining the suction pressure at a target value. Accordingly, the functions of the control valve 49 include changing the target value of the suction pressure in accordance with the magnitude of the supplied current and allowing the compressor to operate at the minimum displacement at any given suction pressure. A compressor equipped with such a control valve 49 varies the cooling ability of the air conditioner.

When the inclination of the swash plate 23 is minimum as illustrated in FIG. 2, the shutter surface 34 of the shutter 28 abuts against the positioning surface 33. The abutment disconnects the suction passage 32 from the suction chamber 27. This stops the gas flow from the external refrigerant circuit 76 to the suction chamber 38, thereby stopping the circulation of refrigerant gas between the circuit 76 and the compressor.

The minimum inclination of the swash plate 23 is slightly larger than zero degrees. Therefore, even if the inclination of the swash plate 23 is minimum, refrigerant gas in the cylinder bores 12*a* is discharged to the discharge chamber 39 and the compressor operates at the minimum displacement. The refrigerant gas discharged to the discharge chamber 39 from the cylinder bores 12*a* enters the crank chamber 15 through the supply passage 48. The refrigerant gas in the crank chamber 15 is drawn back into the cylinder bores 12*a* through the passage 46, the pressure release hole 47 and the suction chamber 38. That is, when the inclination of the swash plate 23 is minimum, refrigerant gas circulates within the compressor traveling through the discharge chamber 39, the supply passage 48, the crank chamber 15, the passage 46, the pressure release hole 47, the suction chamber 38 and the cylinder bores 12*a*. This circulation of refrigerant gas allows lubricant oil contained in the gas to lubricate the moving parts of the compressor.

FIG. 3 is a perspective view illustrating the swash plate 23 with a part cut away. The imaginary plane H1 divides the swash plate into a first portion 231 and a second portion 232. The first portion 231 includes the top dead center point D1 and the second portion 232 includes the bottom dead center point D2. The imaginary plane H2, which is perpendicular to the plane H1, includes the top dead center point D1 and the bottom dead center point D2. The mass of the swash plate 23 is arranged and locates such that the center of gravity G of the swash plate 23 is located on the plane H2 and is displaced from the plane H1 toward the top dead center point D1. In other words, the center of gravity G is located in the first portion 231 of the swash plate 23. Further, the center of gravity G is located close to the front face of the swash plate 23, that is, close to the surface on which the guide pins 25 are formed.

FIG. 4 shows the swash plate 23 at the minimum inclination position. When the swash plate 23 moves from the minimum inclination position illustrated by solid lines to a greater inclination position illustrated by double-dotted lines, the center of gravity G is moved away from the plane H1 as illustrated by arrow A. That is, as the swash plate 23 moves from the minimum inclination position to the maximum inclination position, the center of gravity G is gradually moved further from the plane H1. When the swash plate 23 is at the maximum inclination position, the distance between the center of gravity G and the plane H1 is maximized. When the swash plate 23 is moved between the minimum inclination position and the maximum inclination position, the center of gravity G is always located on the plane H2 and in the first portion 231, which includes the top dead center point D1. The location of the center of gravity G in the swash plate 23 is determined by the mass of the counterweight 59 and the positions of the counterweight 59 and the guide pins 25. In other words, the mass of the swash plate 23 is deliberately arranged to accomplish this result.

If the swash plate 23 starts rotating when at the minimum inclination position illustrated in FIG. 4, a centrifugal force R1 acts on the first portion 231, which includes the top dead center point D1, and a centrifugal force R2 acts on the second portion 232, which includes the bottom dead center point D2. The centrifugal force R1 is greater than the centrifugal force R2. The difference between the forces R1 and R2 is produced based on the location of the center of gravity G of the swash plate 23. The difference between the forces R1 and R2 acts on the swash plate 23 and moves the top dead center point D1 away from the axis L of the drive shaft 16. As a result, a point on the inner wall of the hole 23*a* in the swash plate corresponding to the bottom dead point D2 is pressed against the drive shaft 16. The swash plate 23 at the minimum inclination position rotates integrally with the drive shaft 16 with the point corresponding to the point D2 pressed against the drive shaft 16.

Figure 5:
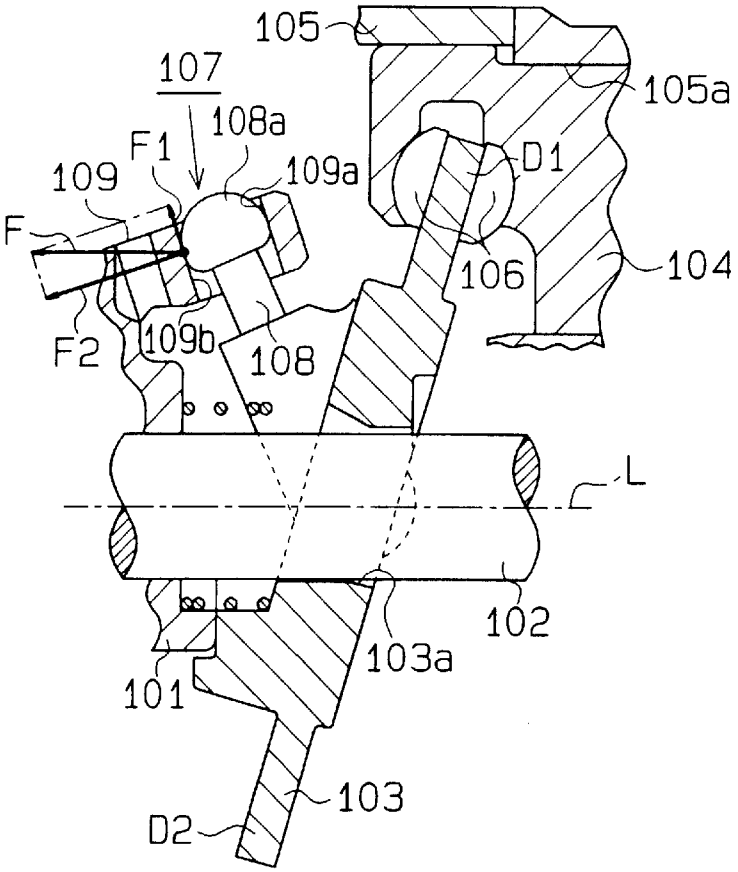
Fig.5 (Prior Art)
FIG. 5 is an enlarged partial cross-sectional view illustrating a swash plate of a prior art variable displacement compressor.

The swash plate 23 is at the maximum inclination position in FIG. 1. In this state, like the prior art compressor of FIG. 5, a force based on the compression reactive force constantly presses the point on the inner wall of the hole 23*a* corresponding to the bottom dead center point D2 against the drive shaft 16. As the swash plate 23 moves from the maximum inclination position to the minimum inclination position, the force based on the compression reactive force (the force moving the top dead center point D1 away from the drive shaft 16) becomes small. However, the force based on centrifugal force acting on the swash plate 23 constantly presses the point on the inner wall of the hole 23*a* corresponding to the point D2 against the drive shaft 16 regardless of the inclination of the swash plate 23.

As described above, the inner wall of the hole 23*a* of the swash plate 23 contacts the drive shaft 16 always at the same location regardless of the inclination of the swash plate 23 and of the displacement of the compressor, which is determined by the inclination of the swash plate 23. Therefore, the swash plate 23 does not radially chatter with respect to the drive shaft 16 despite the clearance between the hole 23*a* and the drive shaft 16. Accordingly, the noise and vibration generated are eliminated.

When the inclination of the swash plate 23 is changed, the radial position of the swash plate 23 relative to the drive shaft 16 remains unchanged. Accordingly, the top clearance of each piston 36 is constant when at the top dead center. This allows the top clearance of each piston 36 to be close to zero without causing the pistons 36 to hit the valve plate 14. Therefore, the compressor constantly operates at high compression ratio at any given inclination of the swash plate 23.

The location of the center of gravity of the swash plate 23 is easily adjusted by changing the weight of the counter weight 59 and the positions of the counter weight 59 and the guide pins 25 relative to the swash plate 23.

When the swash plate 23 is located at the minimum inclination, the shutter 28 stops the flow of refrigerant gas from the external refrigerant circuit 76 to the compressor. In other words, the circulation of the refrigerant between the compressor and the circuit 76 is stopped. This allows the compressor to be operated even if refrigeration is not necessary. Therefore, the compressor 16 is directly coupled to the engine 20 without an expensive and heavy clutch mechanism such as an electromagnetic clutch in between. Thus, the present invention reduces the weight and the cost of the compressor and also prevents passengers from feeling the shock that is produced when the clutch connects or disconnects the compressor and the engine.

As long as the engine 20 runs, a clutchless type variable displacement compressor keeps operating at the minimum displacement when refrigeration is not necessary. Compared to a compressor equipped with a clutch, the clutchless type compressor is more often operated at the minimum displacement. Therefore, vibration and noise generated at the minimum displacement operation are more disturbing. This invention is thus especially advantageous for a clutchless type variable displacement compressor because the radial position of the swash plate 23 relative to the drive shaft 16 is constant.

It should be apparent to those skilled in the art that the present invention may be embodied in many other specific forms without departing from the spirit or scope of the invention. Particularly, it should be understood that the invention may be embodied in the following forms.

In the illustrated embodiment, the center of gravity G of the swash plate 23 is always located in the first portion 231 of the swash plate 23, which includes the top dead center point D1, at any given inclination of the was plate 23. However, the center of gravity G may be located in the second portion 232, which includes the bottom dead center point D2, as long as the force based on the compression reactive force is great enough to press a point on the inner wall of the hole 23*a* of the swash plate 23 corresponding to the bottom dead center point D2 against the drive shaft 16.

The center of gravity G may be displaced from the imaginary plane H2 as long as the center G is located in the first portion 231, which includes the top dead center point D1.

Contrary to the illustrated embodiment, the center of gravity G may be moved toward the imaginary plane H1 as the swash plate 23 moves from the minimum inclination position to the maximum inclination position. In this case, the difference between the centrifugal force R1 acting on the first portion 231 of the swash plate 23 and the centrifugal force R2 acting on the second portion 232 of the swash plate 23 becomes smaller as the inclination of the swash plate 23 increases.

The present invention may be embodied in a clutch type variable displacement compressor.

Therefore, the present examples and embodiments are to be considered as illustrative and not restrictive and the invention is not to be limited to the details given herein, but may be modified within the scope and equivalence of the appended claims.

What is claimed is:

1. A variable displacement compressor comprising:

a housing having a cylinder bore;

a piston located in the cylinder bore;

a drive shaft rotatably supported by the housing;

a rotary support mounted on the drive shaft to rotate integrally with the drive shaft;

a drive plate operably connected to the piston to convert rotation of the drive shaft to reciprocation of the piston, wherein the drive shaft has a central support hole into which the drive shaft is inserted, the support hole allowing the drive plate to be supported tiltably on the drive shaft and to slide in axial directions of the drive shaft, and wherein the drive plate slides and tilts on the drive shaft between a maximum inclination position and a minimum inclination position, and wherein the piston moves by a stroke based on the inclination of the drive plate to change the displacement of the compressor, wherein the mass of the drive plate is arranged and located such that the radial position of the drive plate with the drive shaft is maintained constant by centrifugal force when the drive plate rotates, regardless of the inclination of the drive plate, and wherein the drive plate is divided into a first portion and a second portion by an imaginary plane that includes the axis of the drive shaft, wherein centrifugal force acting on the first portion is greater than the centrifugal force acting on the second portion when the drive plate rotates; and a hinge mechanism located between the rotary support and the drive plate, wherein the hinge mechanism rotates the drive plate integrally with the rotary support and guides the tilting motion and the sliding motion of the drive plate.

2. The compressor according to claim 1, wherein the drive plate has a top dead center point for positioning the piston at a top dead center position in the cylinder bore and a bottom dead center point for positioning the piston at a bottom dead center position in the cylinder bore, wherein the first portion includes the top dead center point and the second portion includes the bottom dead center point.

3. The compressor according to claim 2, wherein the center of gravity of the drive plate is located in the first portion.

4. The compressor according to claim 3, wherein the difference between the centrifugal force acting on the first portion and the centrifugal force acting on the second portion acts on the drive plate to move the top dead center point away from the axis of the drive shaft.

5. The compressor according to claim 4, wherein a clearance is located between the support hole of the drive plate and the drive shaft to allow the drive plate to smoothly move on the drive shaft, wherein an inner wall of the support hole corresponding to the bottom dead center point constantly contacts the drive shaft while the drive plate rotates.

6. The compressor according to claim 3, wherein the imaginary plane is a first imaginary plane, wherein the center of gravity of the drive plate is located on a second imaginary plane that is perpendicular to the first imaginary plane and includes the top and dead center points and the axis of the drive shaft.

7. The compressor according to claim 3, wherein the center of gravity of the drive plate is located in the first portion at least when the drive plate is positioned at the minimum inclination position.

8. The compressor according to claim 3, wherein the hinge mechanism includes a first hinge part fixed to the first portion and a second hinge part fixed to the rotary support to slidably support the first hinge part, wherein one of the first and second hinge parts has a guide surface on which the other hinge part relatively slides, and wherein the guide surface is inclined relative to a plane perpendicular to the axis of the drive shaft.

9. The compressor according to claim 8, wherein when a reactive force generated by gas compression acts on the second hinge part through the piston, the drive plate and the first hinge part, a component of the reactive force acts on the drive plate to move the top dead center point away from the axis of the drive shaft.

10. The compressor according to claim 8, wherein the drive plate includes a counterweight located on the second portion at the opposite side of the first hinge part with respect to the axis of the drive shaft, wherein the location of the center of gravity of the drive plate is determined by the mass of the counterweight and the positions of the counterweight and the first hinge part relative to the drive plate.

11. The compressor according to claim 1 further comprising a shutter for preventing gas from flowing in the compressor when the drive plate is positioned at the minimum inclination position.

12. The compressor according to claim 11, wherein an external driving source is directly connected to the drive shaft for rotating the drive shaft.

13. A variable displacement compressor comprising:

a housing having a cylinder bore;

a piston located in the cylinder bore;

a drive shaft rotatably supported by the housing;

a rotary support mounted on the drive shaft to rotate integrally with the drive shaft;

a drive plate operably connected to the piston to convert rotation of the drive shaft to reciprocation of the piston, wherein the drive plate has a central support hole into which the drive shaft is inserted, the support hole allowing the drive plate to be supported tiltably on the drive shaft and to slide in axial directions of the drive shaft, wherein the piston moves by a stroke based on the inclination of the drive plate to change the displacement of the compressor, wherein the drive plate has a top dead center point for positioning the piston at a top dead center position in the cylinder bore and a bottom dead center point for positioning the piston at a bottom dead center position in the cylinder bore, wherein the drive plate is divided into a first portion including the top dead center point and a second portion including the bottom dead center point by an imaginary plane that includes the axis of the drive shaft, and wherein the mass of the drive plate is arranged and located such that the center of gravity of the drive plate is located in the first portion; and a hinge mechanism located between the rotary support and the drive plate, wherein the hinge mechanism rotates the drive plate integrally with the rotary support and guides the tilting motion and the sliding motion of the drive plate, wherein the hinge mechanism includes a first hinge part fixed to the first portion and a second hinge part fixed to the rotary support to engage the first hinge part, wherein the second hinge part has a guide hole for slidably receiving the first hinge part, and wherein the axis of the guide hole is inclined relative to a plane perpendicular to the axis of the drive shaft.

14. The compressor according to claim 13, wherein the imaginary plane is a first imaginary plane, wherein the center of gravity of the drive plate is located on a second imaginary plane that is perpendicular to the first imaginary plane and includes the top and dead center points and the axis of the drive shaft.

15. The compressor according to claim 13, wherein centrifugal force acting on the first portion is greater than centrifugal force acting on the second portion when the drive plate rotates, and wherein the difference between the centrifugal force acting on the first portion and the centrifugal force acting on the second portion acts on the drive plate to move the top dead center point away from the axis of the drive shaft.

16. The compressor according to claim 15, wherein when a reactive force generated by gas compression acts on an inner wall of the guide hole through the piston, the drive plate and the first hinge part, a component of the reactive force acts on the drive plate to move the top dead center point away from the axis of the drive shaft.

17. The compressor according to claim 16, wherein a clearance is located between the support hole of the drive plate and the drive shaft to allow the drive plate to smoothly move on the drive shaft, wherein an inner wall of the support hole corresponding to the bottom dead center point constantly contacts the drive shaft while the drive plate rotates.

18. The compressor according to claim 17, wherein the drive plate includes a counterweight located on the second portion at the opposite side of the first hinge part with respect to the axis of the drive shaft, wherein the location of the center of gravity of the drive plate is determined by the mass of the counterweight and the positions of the counterweight and the first hinge part relative to the drive plate.

19. A swash plate used for a variable displacement compressor, wherein the compressor includes a piston, which is located in a cylinder bore and operably connected to the swash plate, and a rotary support fixed on a drive shaft, wherein the swash plate has a central support hole into which the drive shaft is inserted, the support hole allowing the drive plate to be supported tiltably on the drive shaft and to slide in axial directions of the drive shaft, wherein a hinge mechanism is located between the rotary support and the swash plate, wherein the hinge mechanism rotates the swash plate integrally with the rotary support and guides the tilting motion and the sliding motion of the swash plate, the swash plate comprising:

a top dead center point for positioning the piston at a top dead center position in the cylinder bore;

a bottom dead center point for positioning the piston at a bottom dead center position in the cylinder bore; and a center of gravity that is displaced from the axis of the drive shaft toward the top dead center point.

* * * * *